US007252755B2

(12) United States Patent
Kiser et al.

(10) Patent No.: US 7,252,755 B2
(45) **Date of Patent: *Aug. 7, 2007**

(54) VISCOSITY MODIFICATION OF HEAVY HYDROCARBONS

(75) Inventors: Melvin D. Kiser, Huntington, WV (US); David C. Boyer, Huntington, WV (US)

(73) Assignee: Marathon Ashland Petroleum Co., Findlay, OH (US)

( * ) Notice: Subject to any disclaimer, the term of this patent is extended or adjusted under 35 U.S.C. 154(b) by 518 days.

This patent is subject to a terminal disclaimer.

(21) Appl. No.: 10/409,697

(22) Filed: Apr. 7, 2003

(65) Prior Publication Data

US 2004/0195150 A1 Oct. 7, 2004

(51) Int. Cl.
*C10L 1/00* (2006.01)
*C10C 3/00* (2006.01)

(52) U.S. Cl. ..... 208/23; 208/22; 208/39; 208/44; 585/3; 106/269; 106/281; 106/281 R

(58) Field of Classification Search ..... 208/39, 208/44, 22, 23; 106/269, 281, 281 R; 585/3
See application file for complete search history.

(56) References Cited

U.S. PATENT DOCUMENTS 2,686,728 A 8/1954 Wallace
2,691,621 A * 10/1954 Gagle ..... 208/23
4,085,078 A 4/1978 McDonald
4,151,003 A 4/1979 Smith et al.
4,539,012 A 9/1985 Ohzeki et al.
4,647,313 A * 3/1987 Clementoni ..... 106/269
4,877,513 A 10/1989 Haire et al.
4,957,511 A 9/1990 Ljusberg-Wahren
5,096,566 A 3/1992 Dawson et al.
5,320,671 A 6/1994 Schilling
5,328,505 A 7/1994 Schilling
5,474,607 A 12/1995 Holleran
5,746,906 A 5/1998 McHenry et al.
5,834,539 A 11/1998 Krivohlavek
6,015,440 A 1/2000 Noureddini
6,174,501 B1 1/2001 Noureddini
6,203,585 B1 3/2001 Majerczak
6,235,104 B1 5/2001 Chattopadhyay et al.
6,348,074 B2 2/2002 Wenzel
6,399,800 B1 6/2002 Haas et al.
6,827,841 B2 * 12/2004 Kiser et al. ..... 208/22

* cited by examiner

*Primary Examiner*—Glenn Caldarola
*Assistant Examiner*—Prem C. Singh
(74) *Attorney, Agent, or Firm*—Emch, Schaffer, Schaub & Porcello Co., L.P.A.

(57) ABSTRACT

A low-viscosity, high-softening point heavy hydrocarbon material having a viscosity-reducing amount of at least one biodiesel material dissolved in a heavy hydrocarbon, and a method for producing such low-viscosity, high-softening point heavy hydrocarbon material are disclosed.

28 Claims, 9 Drawing Sheets

VISCOSITY MODIFICATION OF HEAVY HYDROCARBONS

FIELD OF THE INVENTION

The present invention relates to the use of oxygenated compounds, specifically esters, more specifically, methyl esters such as biodiesel material as viscosity modifiers for heavy hydrocarbons such as asphalt and pitch.

BACKGROUND OF THE INVENTION

Petroleum pitch competes with coal tar pitch in many applications where the pitch is used as a carbon source and/or as a binder. The critical properties that are evaluated when deciding what type of pitch to use include: (a) flow properties, as measured by softening point and/or viscosity, and (b) carbon yield, as measured by ASTM D 2488, Coking Value by Modified Conradson Carbon.

Another pitch property that is also becoming of increasing interest is the polycyclic aromatic hydrocarbon content. The U.S. Pat. No. 5,746,906 patent describes a coal tar pitch having a low polycyclic aromatic hydrocarbon content and a method of making such pitch where a high softening point coal tar pitch (softening point of 120-175° C.) was mixed with a low softening point petroleum pitch to make a binder pitch having a softening point of 107-114° C. and a polycyclic aromatic hydrocarbon content slightly above 15,000 ppm.

In the manufacture of coal tar pitch, if more low boiling point materials are left in the pitch product, the resulting product has a lower softening point and a lower viscosity. In the case of petroleum pitch manufacturing, a high softening point petroleum pitch can be "cut back" with a hydrocarbon liquid material to produce a petroleum pitch having a lower softening point and a lower viscosity at a given temperature. It has long been understood in the industry, that a relationship between the softening point and viscosity exists (i.e., if one were lowered, the other would be lowered also).

Generally speaking, for a given softening point/viscosity, a petroleum pitch will have a lower carbon yield than a coal tar pitch. However, despite a potentially lower carbon yield, petroleum pitch offers certain advantages over coal tar pitch. One advantage that petroleum pitch has over coal tar pitch is the significantly lower concentration of solids of the petroleum pitch material. It is desired in the industry to fine a way to improve the flow properties (i.e., decrease the softening point and viscosity) with minimum effect on the carbon yield of petroleum pitch.

In the past, many types of materials have been used to modify the flow properties of such petroleum products as pitch and asphalt. Historically, these have been petroleum based, non-oxygenated hydrocarbons such as diesel fuel or various types of fuel oils, kerosene or various cutback oils. However, the use of these solvent "cutback" materials often has a dramatic effect on the carbon yield of the petroleum pitch and may cause problems with flash point due to increased volatility of the final product.

Examples of viscosity modification of bituminous materials include the use of a fluoro or chlorofluoro derivative of lower alkanes, such as disclosed in Smith et al., U.S. Pat. No. 4,151,003. The halogen content of the final product is a concern. The viscosity of the heavy hydrocarbons is significantly cut by the halogens to allow transport of the heavy hydrocarbons such as by pipeline. However, the presence of halogens in the final product causes other problems unless the halogenated material is removed. In contrast, the viscosity modification of the present invention does not have this problem.

Still other methods include reducing the viscosity of heavy hydrocarbon oils by preheating a stream of heavy carbon hydrocarbon oil in a stream of gas, mixing under pressure, and passing through a nozzle to form fine oil droplets such that a strong shearing action is created as the heavy oil and gas are forced through an orifice, as described in Dawson et al. U.S. Pat. No. 5,096,566.

In other situations, such as hydrocarbon/water emulsions, various viscosity modified emulsions are described. For example, the Schilling U.S. Pat. No. 5,320,671 describes mixing a bituminous emulsion aggregate slurry with a cationic emulsifier prepared as a reaction process of a polyamine with polycarboxylic acid hydrides and a kraft lignin. Other emulsions are described in the Schilling U.S. Pat. No. 5,328,505, Holleran, U.S. Pat. No. 5,474,607, and Krivohlavek, U.S. Pat. No. 5,834,359. Still other dispersant/emulsions are described in Wallace, U.S. Pat. No. 2,686,728; Ljusberg-Wahren, U.S. Pat. No. 4,957,511; McDonald, U.S. Pat. No. 4,085,078; Haire et al., U.S. Pat. No. 4,877,513 (also generally described in the abstract Haire, B. UNITAR 5$^{th}$ International Conference (Caracas 8/4-9/91) Proceedings V2, 121-126 (1991)); and Ohzeki et al., U.S. Pat. No. 4,539,012.

While these references describe viscosity reduction of emulsions, such references are not be considered applicable to the current invention since the viscosity reduction disclosed herein is for neat hydrocarbons, not a hydrocarbon/water emulsion.

Therefore, there is a need to produce a viscosity modifier that is useful with petroleum pitches, but does not have the above described drawbacks associated with the viscosity modifiers currently in use.

In particular, there is a need for a viscosity modifier that provides improved characteristics to the pitch and the pitch end product.

There is a further need for a viscosity modifier useful with heavy hydrocarbons which provides improved safety features such as low volatility and low toxicity. In specific examples, i.e., petroleum pitch, there is a need for viscosity modification without having a significant effect on carbon yield.

Recently, the use of biodiesels, such as methyl esters of fatty acids derived from either soybean or animal fats have received some attention to augment diesel fuel supplies in the United States. Until the present invention, however, no one had thought to use oxygenated compounds, specifically esters, more specifically methyl esters and even more particular, biodiesel, as a viscosity reduction agent for heavy hydrocarbons regardless or origin, including, in particular, petroleum based hydrocarbons such as asphalt cements and petroleum pitch as well as coal tar derived heavy hydrocarbons.

SUMMARY OF THE INVENTION

In one aspect, the present invention relates to a method of reducing the viscosity of heavy hydrocarbon materials. According to one aspect of the present invention, the heavy hydrocarbon material is heated to produce a molten material. A viscosity reducing agent consisting of an oxygenated compound such as ethylene glycol, dibasic ester or biodiesel is dissolved in the molten material. In certain embodiments, the starting heavy hydrocarbon material has a softening point above about 50° C. Also, in preferred embodiments, from about 0.5 to about 20%, by weight, of the biodiesel is dissolved in the heavy hydrocarbon material.

According to certain aspects of the present invention, the heavy hydrocarbon material can comprise a petroleum pitch, coal tar pitch, or other suitable pitch materials.

In another aspect, the present invention relates to a low viscosity, high softening point, heavy hydrocarbon material having a relatively high softening point and a relatively high viscosity having a suitable amount of at least one biodiesel material dissolved in the heavy hydrocarbon material.

According to certain aspects of the present invention, the biodiesel material comprises at least one oxygenate compound such as esters derived from vegetable oils and/or animal fats. In certain embodiments, the biodiesel material comprises suitable fatty acid methyl esters.

Yet another aspect of the present invention relates to a method of reducing the concentration of regulated polycyclic aromatic hydrocarbons specifically those noted by OSHA 1910.1200 of a pitch product made from a starter pitch. The starter pitch comprises a full range pitch fractions where the more volatile, undesirable polycyclic aromatic hydrocarbons are removed from the pitch by distillation. The residue from this distillation has an unacceptable high molten viscosity. The viscosity of the reduced carcinogen pitch fraction is then reduced by dissolving therein a viscosity reducing amount of at least one biodiesel material. The product is a low carcinogen pitch product having an acceptable molten viscosity.

DETAILED DESCRIPTION OF THE PREFERRED EMBODIMENT

Figure 1:
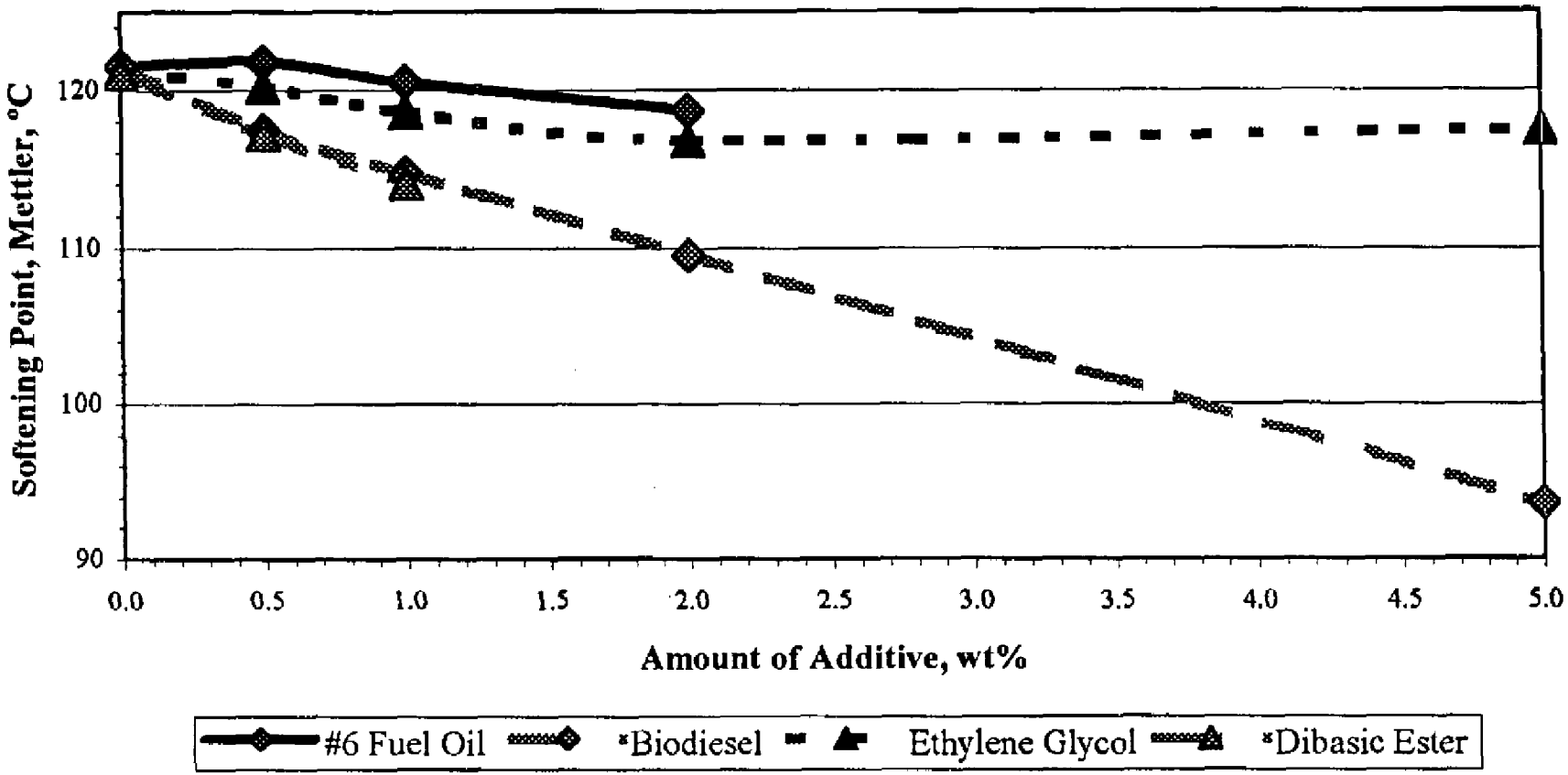
FIG. 1 is a graph showing effect on the softening point of A-240 pitch for various amounts of various viscosity modifiers for: #6 fuel, biodiesel, ethylene glycol, and dibasic ester (DBE).

The present invention relates to a method for reducing the viscosity of heavy hydrocarbon materials including, for example, pitch and asphalt type materials. The method involves heating the heavy hydrocarbon material to produce a molten material and dissolving in that molten material in a viscosity reducing agent consisting of an oxygenated compound such as ethylene glycol, dibasic ester or biodiesel. In certain preferred embodiments, the heavy hydrocarbon material has a softening point above about 50° C. and in other embodiments above about 120° C. In certain aspects, the present invention, relates to a method where from about 0.5 to about 20%, by wt, and in certain embodiments, from about 0.5 to about 10%, by wt, of the biodiesel is dissolved in the heavy hydrocarbon materials.

It should be understood that the heavy hydrocarbon materials can include both natural and synthetic pitches and that such materials can be used with the present invention. In certain aspects, the pitches derived from coal or petroleum are specially preferred.

Suitable petroleum pitches are obtained, for example, as extraction residues by deasphalting treatment of heavy hydrocarbon oils, such as vacuum residue; residues from products of thermal cracking treatment of heavy hydrocarbon oils; residues from products of catalytic cracking of petroleum fractions; and from products of heat treatment from heavy carbon oils. Suitable coal tar pitches include vacuum bottoms of byproducts from the production of metallurgical coke from coal. Also, both the petroleum and coal pitches can be modified to reduce their viscosity with the method of the present invention.

The pitch products produced by the method of the present invention have a desired low viscosity, a desired high coking value, and a desired softening point.

It is not until the present invention that ester materials such as biodiesel materials were thought of to reduce the viscosity of heavy hydrocarbons in materials such as pitch and asphalt.

We discovered that it was possible to use biodiesel, a natural oil derived from vegetable oils or animal fats, as a viscosity modifier for heavy hydrocarbons regardless of method of manufacturer. So far as is known, biodiesel has never been used at a viscosity modifier before the present invention, though use of biodiesel as a release agent has been reported. For example, the following web site: http://www.soyqold.com/manyuses.htm teaches use of biodiesel as a release agent. Also, http://www.apexnorth.com/applications/ teaches similar uses (e.g., asphalt release agent).

Biodiesels have been found to be useful as fuels because the biodiesels have a low vapor pressure, are non-toxic and are stable (as per HMIS regulation), and do not deteriorate or detonate upon mild heating.

Until the present invention, however, no-one had thought to use oxygenates, specifically esters, more specifically methyl esters such as biodiesel, as suitable for a viscosity modifier for heavy hydrocarbon materials (such as pitch and asphalt) since pitch and asphalt have high molecular weights and are highly aromatic. In contrast, the oxygenate compounds are aliphatic, have very little (i.e., <0.1 wt %) sulfur, have no ring structures or aromatics, and are relatively low molecular weight, as compared to asphalt and pitch. Also, the oxygenate compounds contain relatively large amounts of oxygen, often approaching 10%. While some might have argued that a linear, relatively low molecular weight, aliphatic molecule, such as biodiesel, would be a good release agent, until the present invention, the use of oxygenate compounds were not thought to be considered suitable as a viscosity modifier.

In spite of the teachings of the art, it was surprisingly found that the aliphatic oxygenates, specifically esters, more specifically methyl esters such as biodiesel materials, work well as viscosity modifiers for heavy hydrocarbon materials.

Biodiesels are derived from triglycerides, three fatty acids bound by glycerol. If the source is animal fat, e.g., tallow or lard or whale oil, the fatty acids are saturated, that is they contain no double bonds. If the source is vegetable, the fatty acids are unsaturated and contain one or more double bonds. Some highly unconventional sources have also been studied, including over 20 years of work on making biodiesel from algae, as reported in Biodiesel from Algae, A Look Back at the U.S. Department of Energy's Aquatic Species Program, which reported that the algae species studied in the program could produce up to 60% of their body weight in the form of triacylglycerols, the same natural oil made by oilseed crops. The complete report is expressly incorporated by reference and available at http://www.ott.doe.gov/biofuels/pdfs/biodiesel from algae ps.pdf.

For example, one preferred route for making biodiesel is to break the fatty acids free from the glycerol. Other methods of manufacturing biodiesel are found in U.S. Pat. No. 6,399,800; U.S. Pat. No. 6,348,074; U.S. Pat. No. 6,015,440; U.S. Pat. No. 6,203,585; U.S. Pat. No. 6,174,501; and U.S. Pat. No. 6,235,104, which are expressly incorporated by reference.

Useful "biodiesel" materials, as used herein, include mono alkyl esters of a ling chain fatty acid derived from renewable lipid sources. Suitable sources include animal fats and vegetable oils, including, for example, soybean oil, sunflower oil, linseed oil, coconut oil, and the like.

Other useful biodiesel materials for use in the present invention comprise a mixture of fatty acid esters. Typically these materials are made by the transesterification of vegetable oil to biodiesel. One route to biodiesel involves reacting a vegetable oil (a triglyceride) with an alcohol, preferably methanol, to form biodiesel and glycerol. The biodiesel produced from vegetable oil may have the formula:

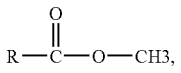

where R is typically 16-18 carbon atoms and may contain one or more C═C bonds.

It should be understood that the biodiesels can comprise methyl esters that contain, for example, $C_6$-$C_{14}$ fatty acids such as caproic, caprylic, capric, lauric, and myristic. The term "biodiesel" can also include, for example, methyl esters of $C_{12}$-$C_{22}$ fatty acids such as lauric acid, myristic acid, palmitic acid, palmitoleic acid, stearid acid, oleic acid, elaidic acid, petroselic acid, ricinoleic acid, elaeosteric acid, linoleic acid, linolenic acid, arachic acid, gadoleic acid, behenic acid and erucic acid. It should be understood however, that, in other embodiments, other useful biodiesel materials and mixtures of these and other biodiesels, are within the contemplated scope of the present invention.

In one aspect, the present invention relates to the use of low concentrations of biodiesels to produce a significant reduction in the softening point of heavy hydrocarbons. By blending the methyl esters such as biodiesel with heavy hydrocarbons, the softening points of the heavy hydrocarbons, such as petroleum pitch, are reduced while having a minimum impact on the coking value of the final product. In one embodiment, blending about 2 wt % biodiesel into A-240 pitch (having 121.1° C. softening point and a coking value of 51.1 wt %) produces a pitch having a 109.5° C. softening point and a coking value of 50.5 wt %.

Low concentrations of methyl esters cause significant changes in the viscosity of heavy hydrocarbons. The viscosity reduction observed with biodiesel is significantly greater than that observed with similar blends of A-240 pitch and No. 6 fuel oil. The addition of about 2 wt % No. 6 fuel oil in A-240 pitch causes a viscosity reduction of 15% at 150° C., while the addition of about 2 wt % biodiesel to A-240 petroleum pitch causes a 65% viscosity reduction at the same temperature.

While not wishing to be bound by theory, it is believed that the ability of methyl esters to reduce viscosity in heavy hydrocarbons is a function of the original viscosity of the hydrocarbon. That is, the greatest percent reduction of viscosity occurs with samples under conditions where the absolute viscosity is highest. In particular, significant viscosity reductions are seen for samples and temperatures where the viscosity is above about 100 centipoise.

The use of biodiesel has little or no detrimental impact on other critical parameters of heavy hydrocarbons. Since sources of methyl esters, such as biodiesel, have low concentrations of ash and sulfur, the addition of these compounds to heavy hydrocarbons such as petroleum pitch does not increase the concentration of these critical (and undesirable) components in the final pitch product.

The methyl esters such as biodiesel materials provide the benefits of fire hazard safety and low toxicity in preparing the pitch materials. These compounds have no unpleasant odor, and although they will burn, they have such a low volatility that the compounds will not form an explosive mixture in air under normal processing conditions. The methyl esters are essentially free of aromatics and considered non-toxic for skin contact and are readily biodegradable, should any spills occur.

According to another aspect of the present invention, the reduction of the softening point/viscosity of petroleum pitch allows petroleum pitch to compete more favorably with coal tar pitch in certain markets. The use of methyl esters/biodiesel materials modifies the pitch product viscosity, which allows the pitch products to be made that better meet customer requirements. Normally, the use of heavy hydrocarbons requires the customer to heat the product to achieve a desired viscosity. With the present invention, customers are able to realize cost savings by being able to use the methyl esters/biodiesel viscosity modified pitch product without the need to heat such product, or, alternatively, to use less energy to heat the pitch products to achieve a desired viscosity.

The present invention also provides for an improved end product. Specifically, in the applications where the biodiesel materials are used with petroleum pitch, a reduced softening point is achieved while still maintaining a desired coking value. This petroleum pitch is especially useful in applications that had not previously been found suitable for neat petroleum pitch (without the biodiesel viscosity modification). For example, the addition of about 2 wt % of biodiesel material to A-240 petroleum pitch provides a 110° C. softening point pitch with a coking value that is more competitive with 110° C. coal tar pitch.

The following examples are intended only to further illustrate the invention and are not intended to limit the scope of the invention as defined by the claims.

EXAMPLE I

The ability of biodiesel compounds to desirably reduce the softening point of A-240 petroleum pitch compared to No. 6 fuel oil, and diabasic esters and ethylene glycol is shown in FIG. 1.

EXAMPLE II

Figure 2:
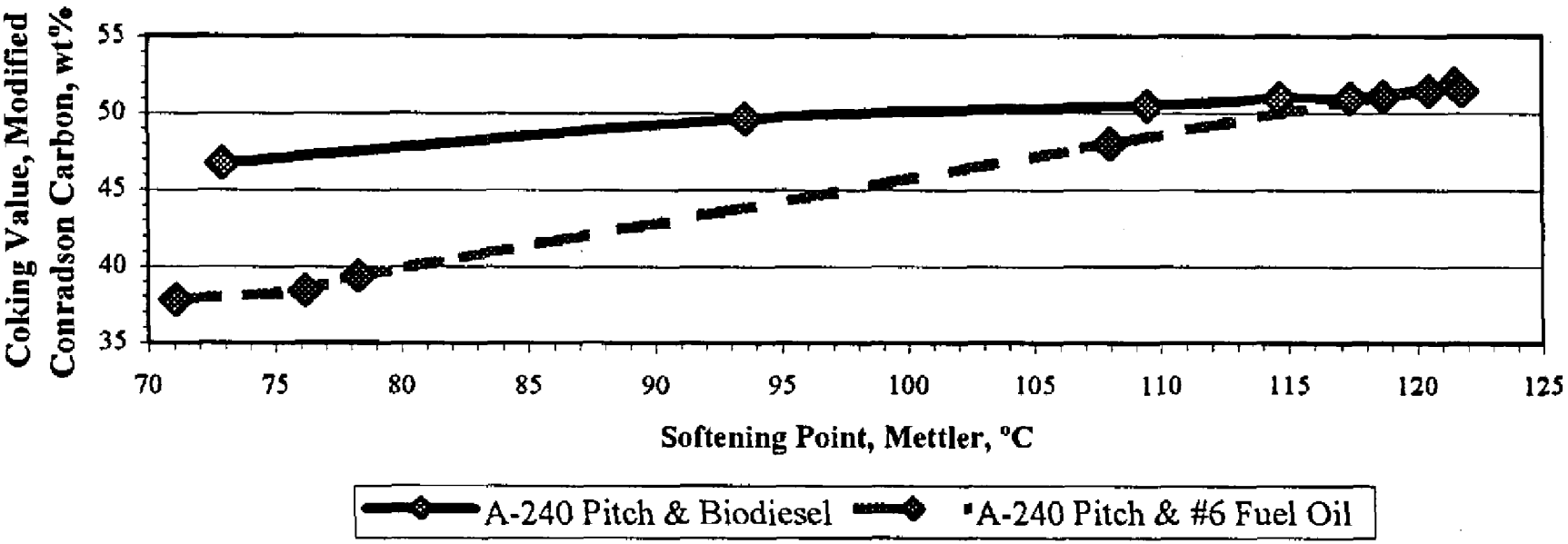
FIG. 2 is a graph showing the coking value versus softening point relationship for pitch blends comprising: A-240 pitch and biodiesel, and A-240 and #6 fuel oil.

Only a small amount of methyl esters/biodiesel is needed to affect a desired change in softening point. The softening point of a 120° C. softening point pitch is reduced without causing a major change in the coking value of the final product. A comparison of the softening point/coking value relationship of standard petroleum products versus blends of petroleum pitch and biodiesel compounds is shown in FIG. 2.

EXAMPLE III

Figure 3:
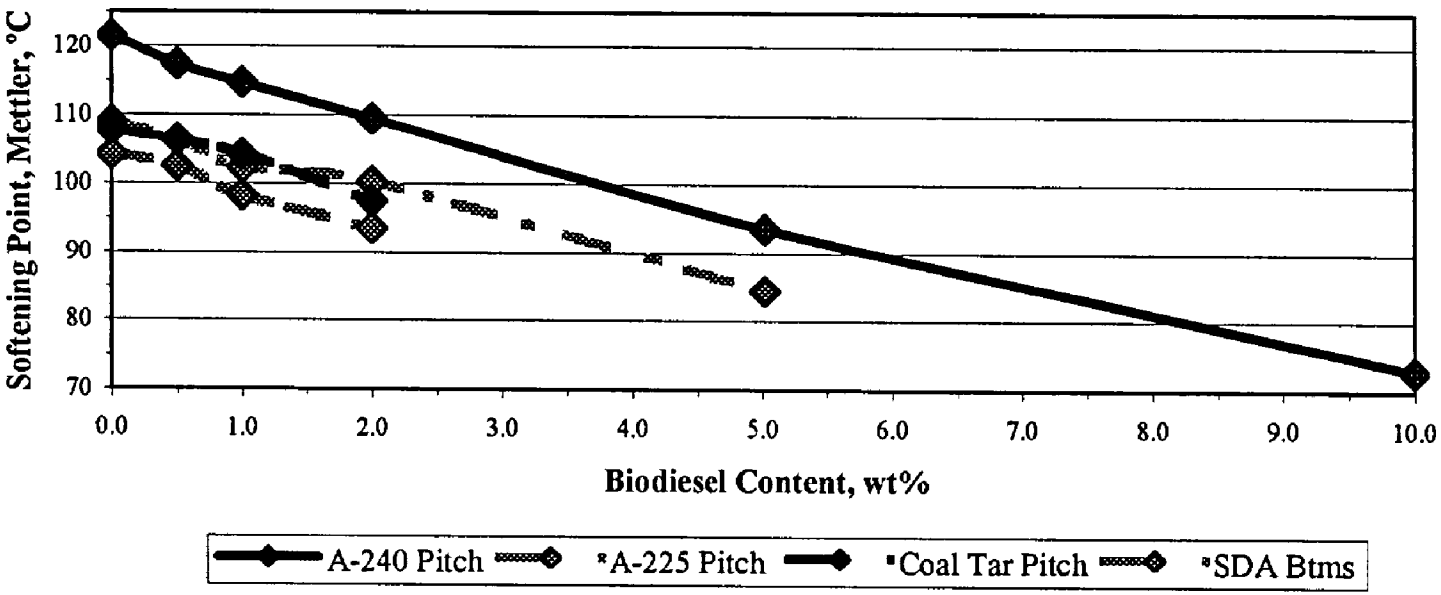
FIG. 3 is a graph showing the effects of various amounts of biodiesel content the softening point for A-240 pitch, A-225 pitch, coal tar pitch, and solvent deasphalt bottoms.
Figure 4:
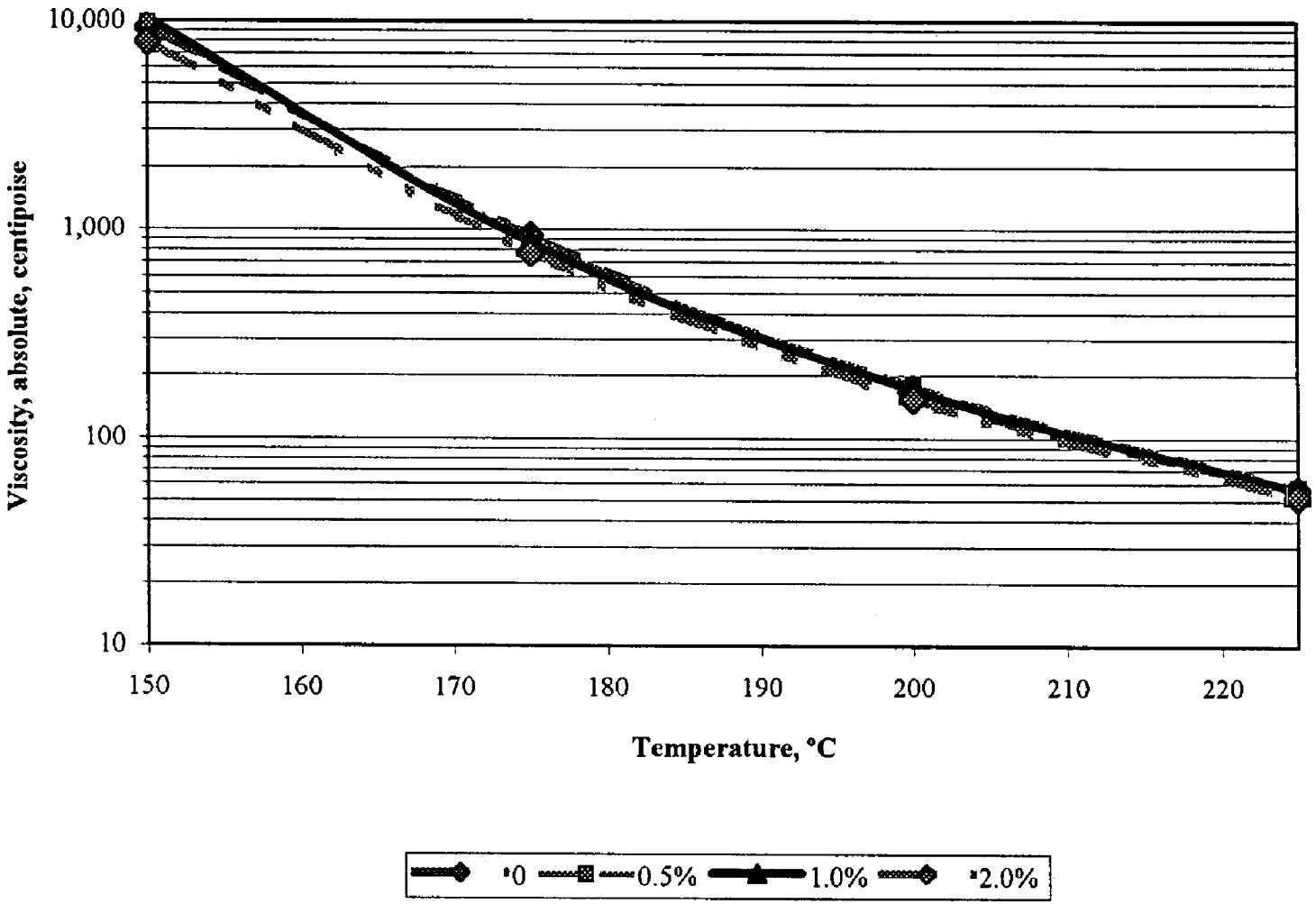
FIG. 4 is a graph showing the relationship between viscosity and temperature for blends of A-240 pitch and #6 fuel oil at 0%, 0.05%, 1% and 2%, by wt. %.
Figure 5:
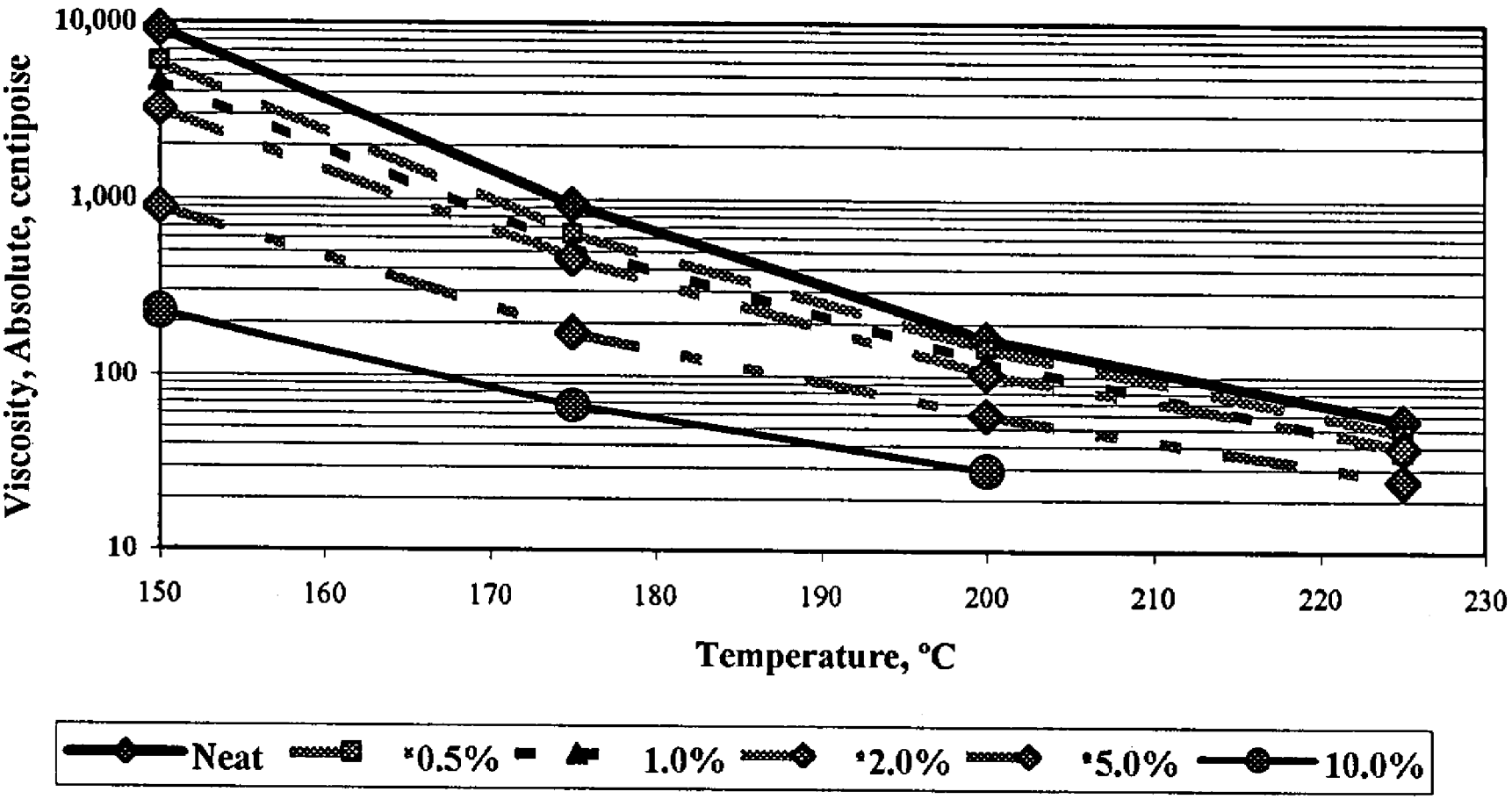
FIG. 5 is a graph showing the relationship between viscosity and temperature for blends of A-240 pitch and biodiesel material at or 0%, 0.5%, 1.0%, 2.0%, 5.0% and 10.0%, by wt. %.
Figure 6:
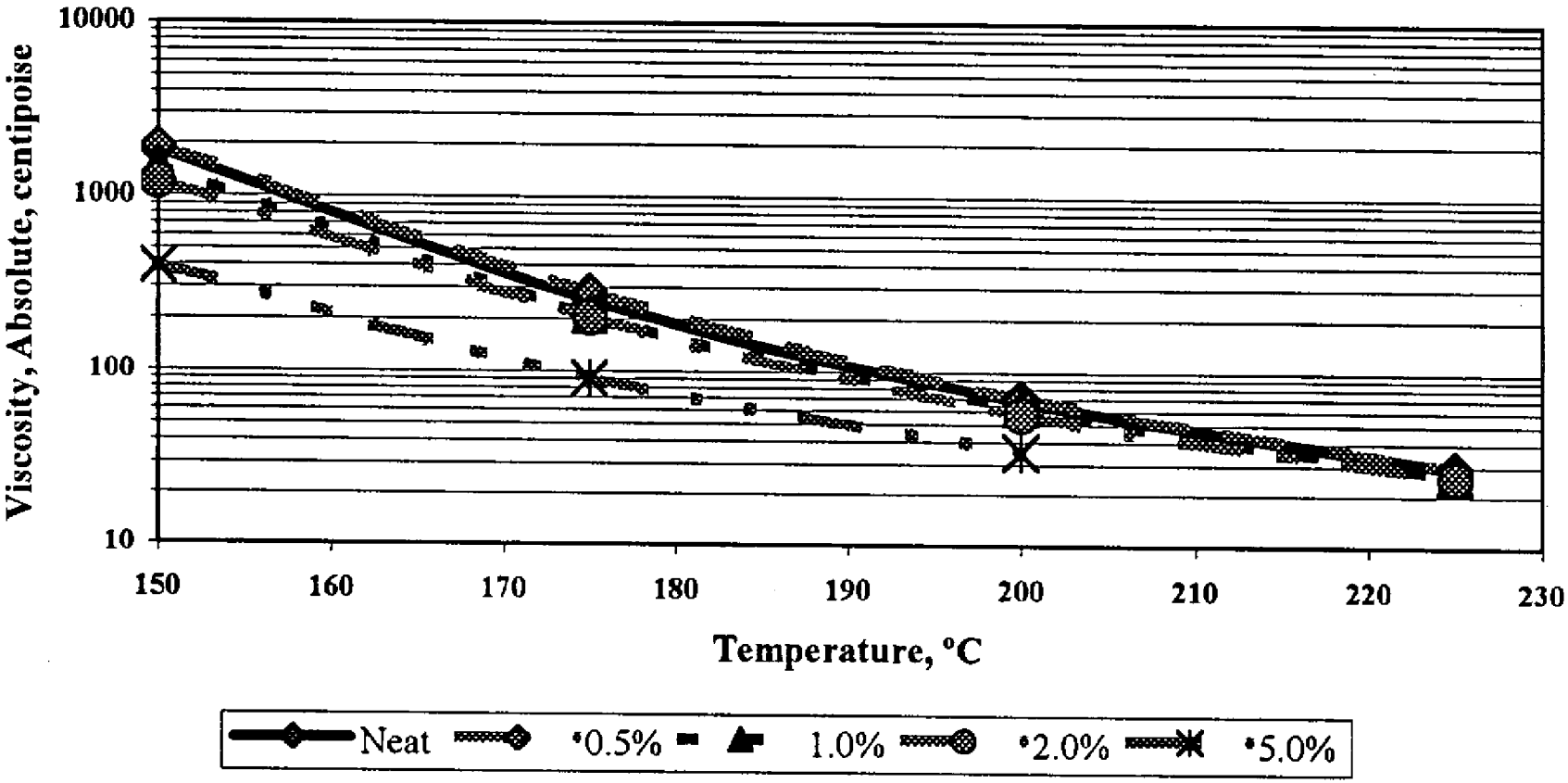
FIG. 6 is a graph showing the relationship between temperature and viscosity for blends of A-225 pitch and biodiesel at or 0%, 0.5%, 1.0%, 2.0% and 5.0%, by wt. %.
Figure 7:
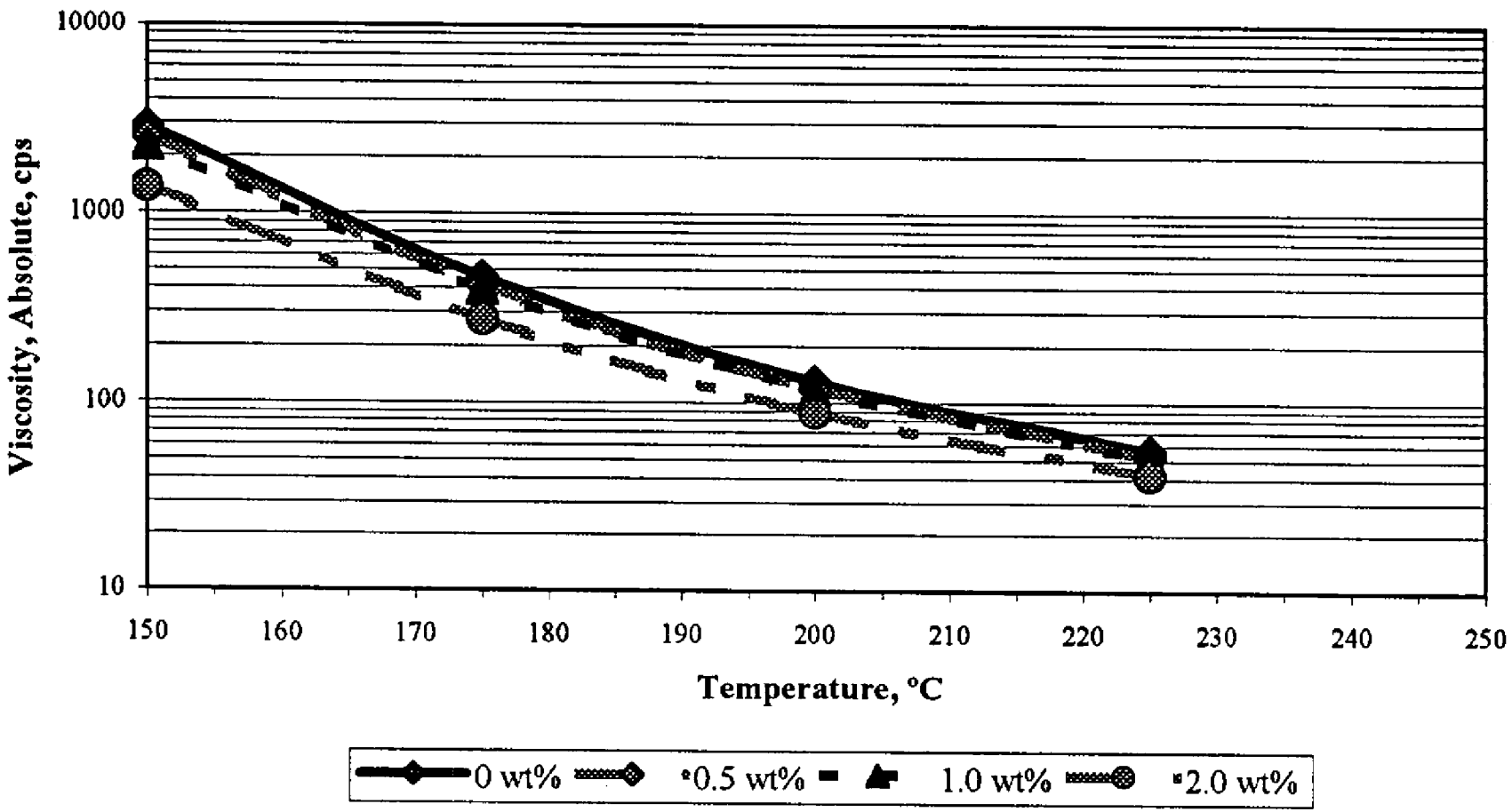
FIG. 7 is a graph showing the relationship between viscosity and temperature for blends of cold tar pitch and biodiesel at 0%, 0.5%, 1.0% and 2.0%, by wt. %.
Figure 8:
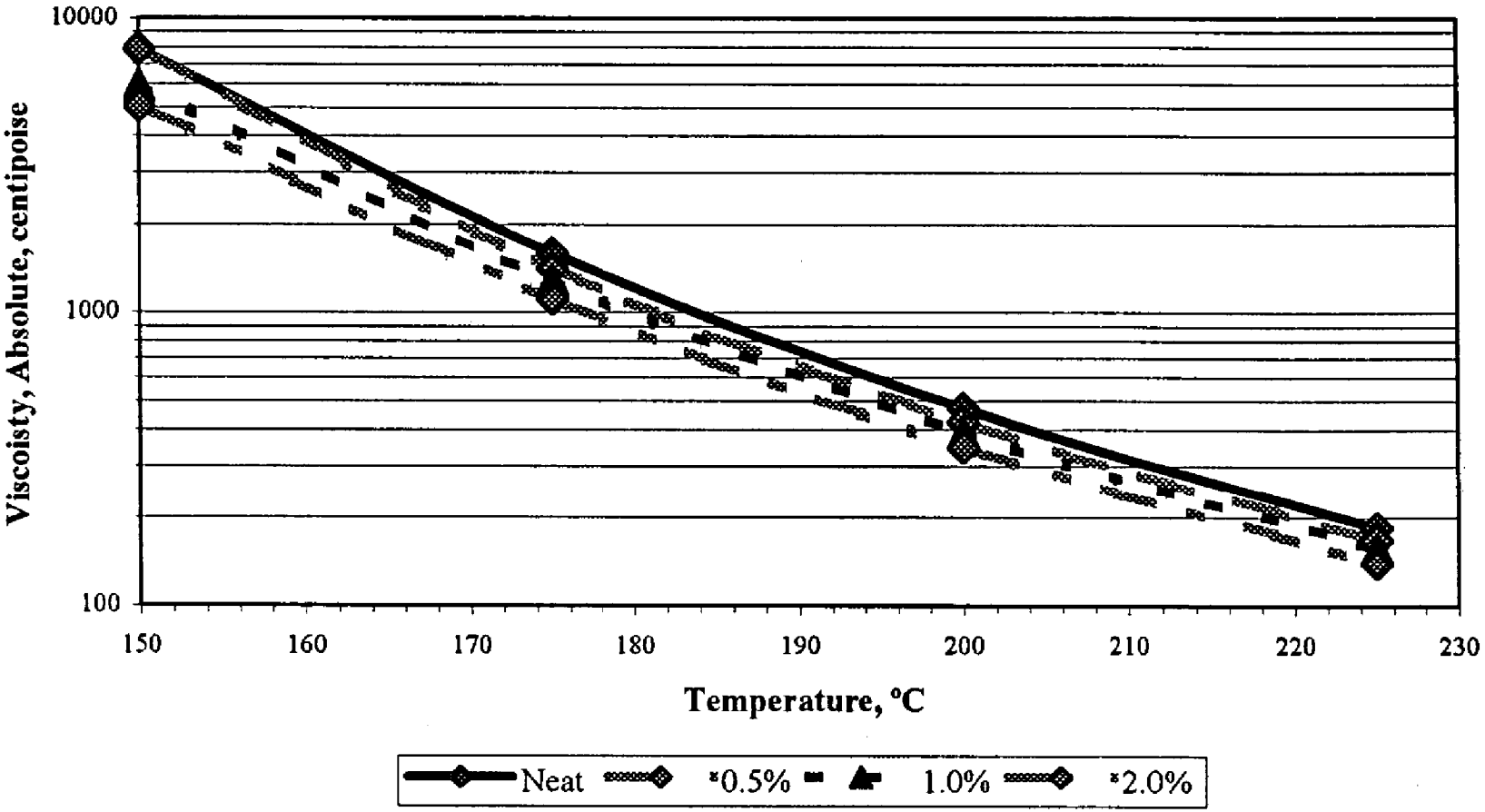
FIG. 8 is a graph showing the relationship between viscosity and temperature for blends of SDA and biodiesel at or 0%, 0.5%, 1.0%, and 2.0%, by wt. %.
Figure 9:
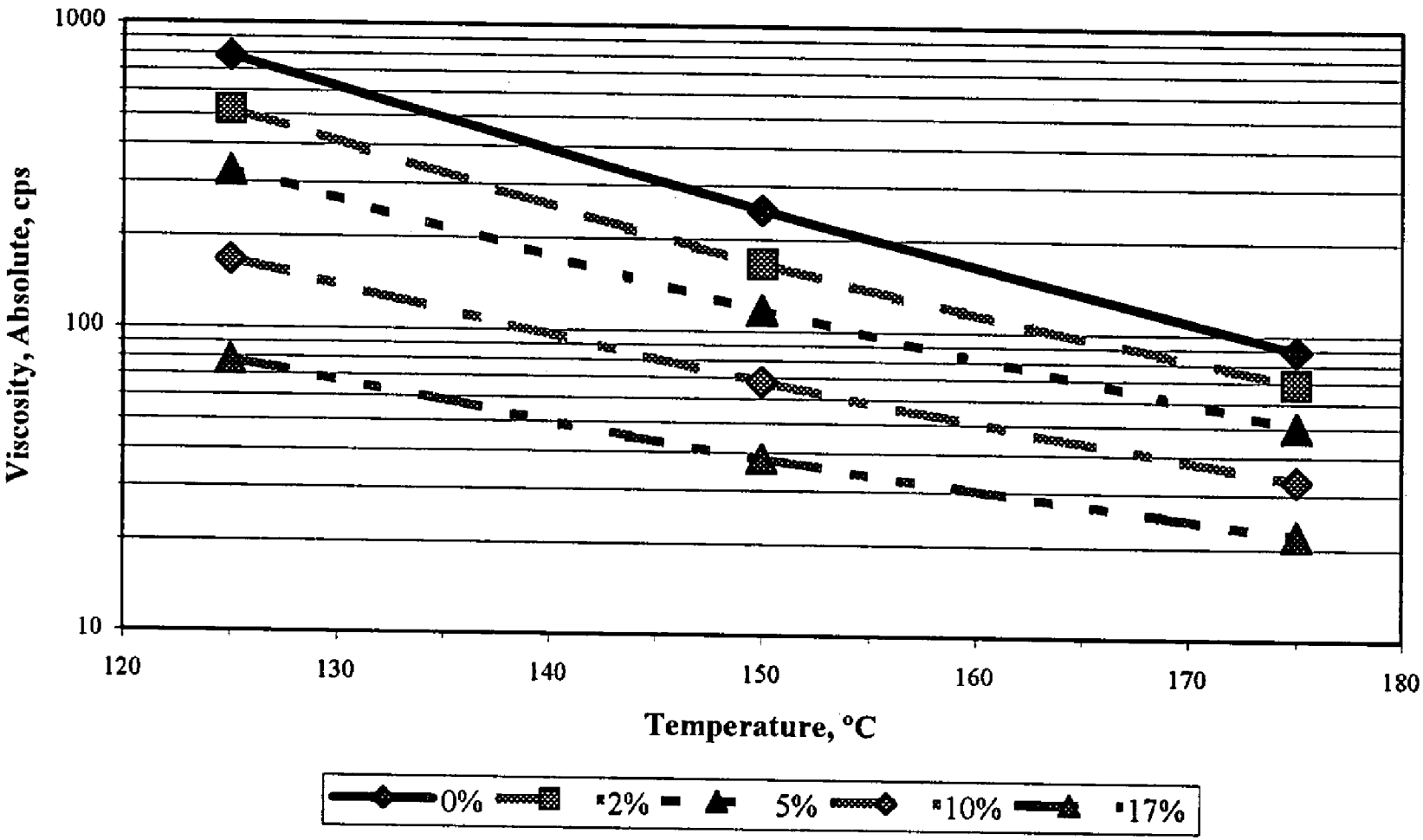
FIG. 9 is a graph showing the relationship between viscosity and temperature for blends of asphalt cement and biodiesel at 0%, 2%, 5%, 10%, and 17%, by wt. %.

The ability of biodiesels to reduce the softening point of heavy hydrocarbons is demonstrated not only with various grades of petroleum pitch but with asphalt cement type petroleum products and coal derived heavy hydrocarbons as well. FIG. 3 shows a comparison between blends of the following hydrocarbons and biodiesel: A-240 petroleum pitch, A-225 petroleum pitch, coal tar pitch and SDA bottoms (solvent deasphalt bottoms).

EXAMPLE IV

The ability of the biodiesel materials to reduce the viscosity of heavy hydrocarbons is also demonstrated. For baseline comparison, the relationship of viscosity versus temperature for blends of A-240 petroleum pitch and No. 6 fuel oil is presented in the Figures. In addition, the viscosity versus temperature curves for blends of biodiesel compounds with A-240 petroleum pitch, A-225 petroleum pitch, a coal tar pitch, and asphalt cement-type products are presented in FIGS. 4, 5, 6, 7, 8 and 9.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A method of reducing the viscosity of heavy hydrocarbon material comprising:

heating the heavy hydrocarbon material to produce a molten material; and dissolving, in the molten material a viscosity-reducing amount of at least one biodiesel material.

2. The method according to claim 1 wherein the hydrocarbon material has a softening point above 50° C.

3. The method of claim 1 wherein the hydrocarbon material has a softening point above about 120° C. and wherein from about 0.5 to about 10 wt % of the at least one biodiesel is dissolved in the hydrocarbon material.

4. The method of claim 1 wherein said 1 to 5 wt % the at least one biodiesel is dissolved in the hydrocarbon material.

5. The method of claim 1, wherein the hydrocarbon material comprises petroleum pitch.

6. The method of claim 1, wherein the hydrocarbon material comprises coal tar pitch.

7. The method of claim 1, wherein the biodiesel material comprises at least one oxygenate compound.

8. The method of claim 1, wherein the biodiesel material comprises at least one type of ester derived from vegetable oils and/or animal fats.

9. The method of claim 1, wherein the biodiesel material comprises suitable fatty acids esters.

10. The method of claim 8, wherein the biodiesel material comprises suitable fatty acid methyl esters.

11. Low viscosity, high softening point heavy hydrocarbon material comprising:

at least one heavy hydrocarbon material having a relatively high softening point and a relatively high viscosity, and at least one viscosity reducing amount of at lease one biodiesel material dissolved in the heavy hydrocarbon material.

12. The hydrocarbon material according to claim 11, wherein the heavy hydrocarbon material has a softening point above about 100° C.

13. The heavy hydrocarbon material of claim 11, wherein the heavy hydrocarbon material has a softening point above about 120° C. and wherein from about 0.5 to about 10 wt % of the at least one biodiesel is dissolved in the heavy hydrocarbon material.

14. The heavy hydrocarbon material of claim 11, wherein about 1 to about 5 wt % of the at least one biodiesel is dissolved in the heavy hydrocarbon material.

15. The heavy hydrocarbon material of claim 11, wherein the heavy hydrocarbon material comprises petroleum pitch.

16. The heavy hydrocarbon material of claim 11, wherein the heavy hydrocarbon material comprises coal tar pitch.

17. The heavy hydrocarbon material of claim 11, wherein the biodiesel material comprises at least one oxygenate compound.

18. The heavy hydrocarbon material of claim 11, wherein the biodiesel material comprises at least one type of ester derived from vegetable oil and/or animal fats.

19. The heavy hydrocarbon material of claim 11, wherein the biodiesel material comprises at least one type of suitable fatty acids ester.

20. The heavy hydrocarbon material of claim 11, wherein the biodiesel material comprises at least one type of suitable fatty acid methyl ester.

21. A method of reducing an amount of polycyclic aromatic hydrocarbons in a starter pitch comprising (i) a distillable pitch fraction, and (ii) a higher boiling, nondistillable, pitch fraction having a reduced regulated polycyclic aromatic hydrocarbon level and an unacceptably high viscosity and/or softening point, the method comprising:

(a) distilling from the starter pitch fraction having a reduced regulated polycyclic aromatic hydrocarbon pitch fraction to produce a pitch fraction with an unacceptably high molten viscosity; and (b) reducing the viscosity of the high viscosity pitch fraction by dissolving therein a viscosity reducing amount of at least one biodiesel material to produce as a product a pitch producing having an acceptable molten viscosity and reduced polycyclic aromatic hydrocarbon content.

22. The method of claim 21, wherein the higher boiling point, or nondistillable, pitch fraction has a softening point greater than about 120° C.

23. The method of claim 21, wherein from about 0.5 to about 10 wt. % of at least one biodiesel material is dissolved in the reduced polycyclic aromatic hydrocarbon pitch fraction.

24. The method of claim 23, wherein the starter pitch comprises petroleum pitch.

25. The method of claim 21, wherein the starter pitch comprises coal tar pitch.

26. The method of claim 21, wherein the biodiesel material comprises at least one oxygenate compound.

27. The method of claim 21, wherein the biodiesel material comprises at least one type of ester derived from vegetable oils and/or animal fats.

28. The method of claim 21, wherein the biodiesel material comprises suitable fatty acid and ethyl esters.

* * * * *